United States Patent [19]

Cohen

[11] 4,077,418

[45] Mar. 7, 1978

[54] QUICKLY ERECTED BACK PACK TENT

[76] Inventor: Wilfred Cohen, 11812 Mt. Robert Ct., Fountain Valley, Calif. 92708

[21] Appl. No.: 704,193

[22] Filed: Jul. 12, 1976

[51] Int. Cl.[2] ..... A45F 1/16

[52] U.S. Cl. ..... 135/4 R; 224/10

[58] Field of Search ..... 224/9, 10, 25 A, 5.1, 224/8 A; 135/4 R, DIG. 9, 5 AT, 5 C

[56] References Cited

U.S. PATENT DOCUMENTS

| | | | |
|---|---|---|---|
| 907,032 | 12/1908 | Gohen | 135/4 R X |
| 1,464,875 | 8/1923 | Hull et al. | 224/9 X |
| 1,509,881 | 9/1924 | Severin | 135/4 R |
| 2,168,913 | 8/1939 | Middleton | 135/4 R X |

FOREIGN PATENT DOCUMENTS

| | | | |
|---|---|---|---|
| 1,337,193 | 10/1962 | France | 135/4 R |
| 172,233 | 1/1935 | Switzerland | 224/9 |
| 889,455 | 2/1962 | United Kingdom | 135/4 R |

*Primary Examiner*—Galen L. Barefoot
*Assistant Examiner*—Winston H. Douglas
*Attorney, Agent, or Firm*—Knobbe, Martens, Olson, Hubbard & Bear

[57] ABSTRACT

A lightweight collapsible tent structure is disclosed which can be folded into a compact "U-shaped" package readily nested around a conventional hiker's back pack thereby facilitating easy transportation through difficult terrain. This tent structure comprises a rectangular tent support frame made of aluminum or plastic tubing which has the ability of being quickly erected from its collapsed state by merely straightening its hinged joints. A rectangular box-like tent fabricated from flame-retardant, water-impervious, nylon material strapped to the tubular framework unfolds into its functional configuration when the frame structure is erected. This tent shelter permits easy attachment to a second unit thus expanding its capacity to accommodate additional occupants.

7 Claims, 16 Drawing Figures

FIG. 1.
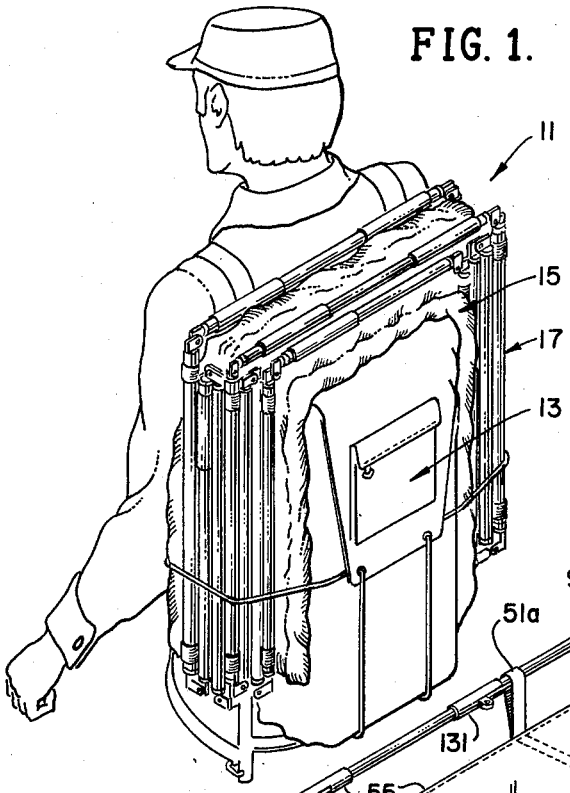
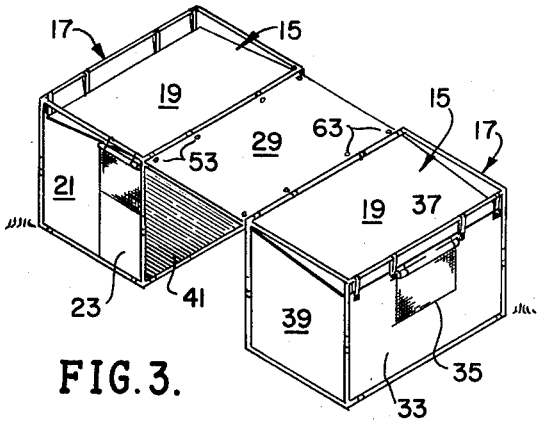
FIG. 3.
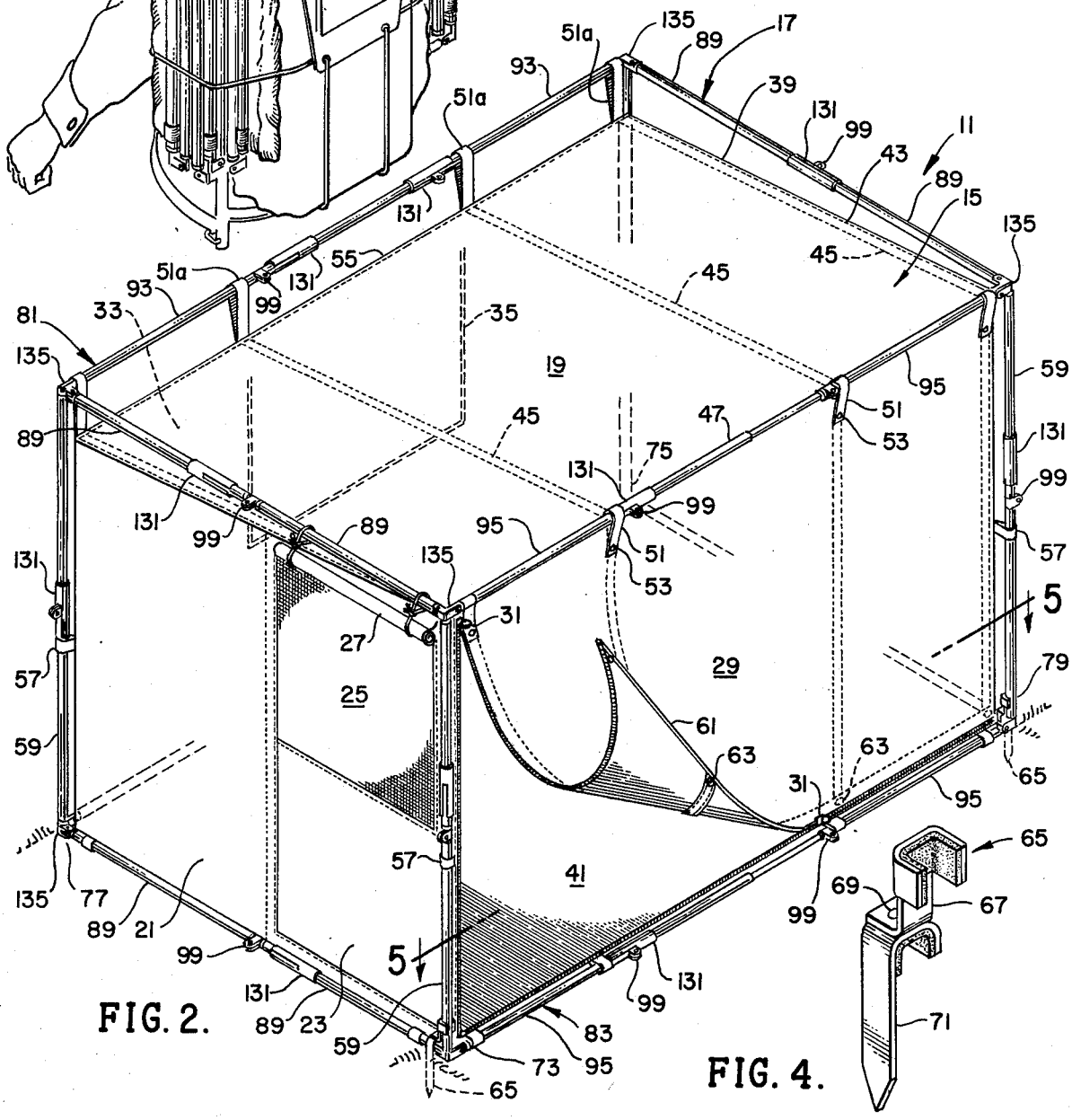
FIG. 2.
FIG. 4.

FIG. 5.
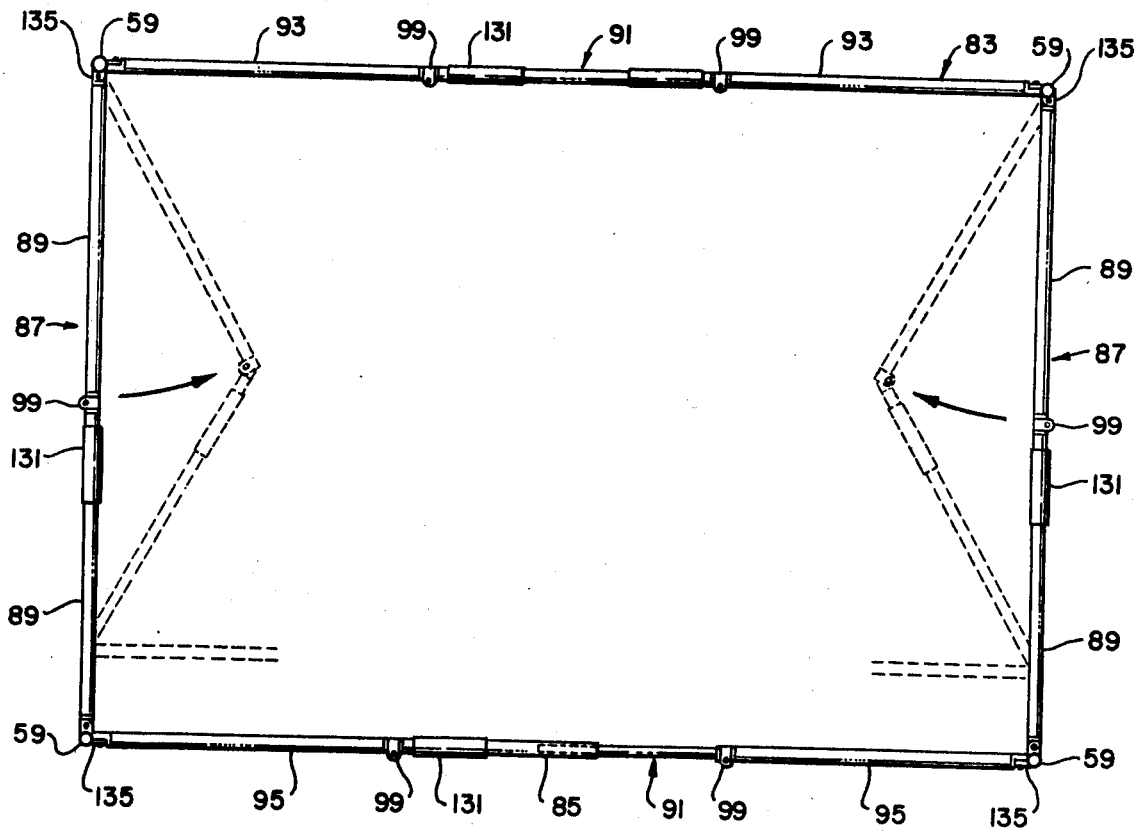
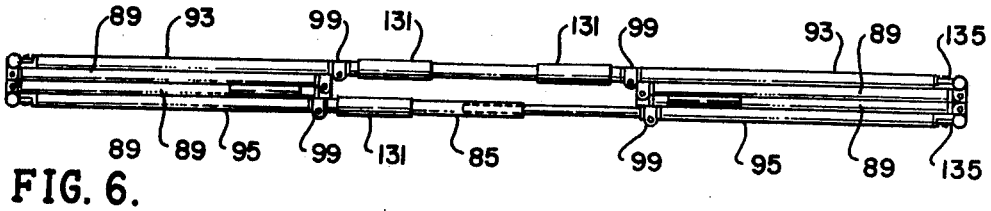
FIG. 6.
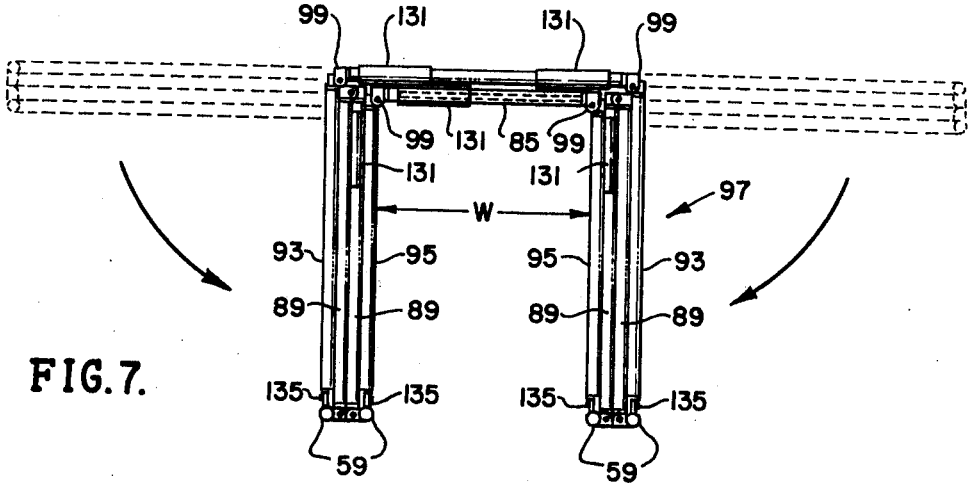
FIG. 7.

FIG. 9.
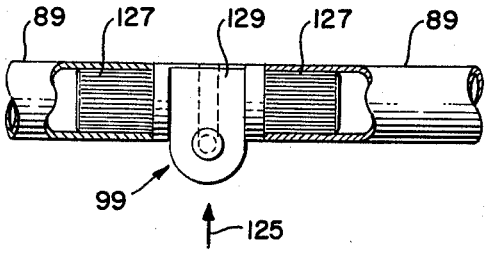
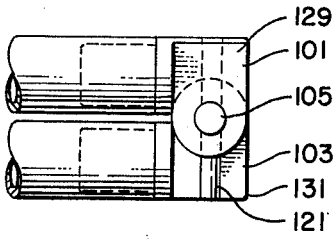
FIG. 10.
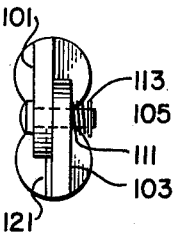
FIG. 11.
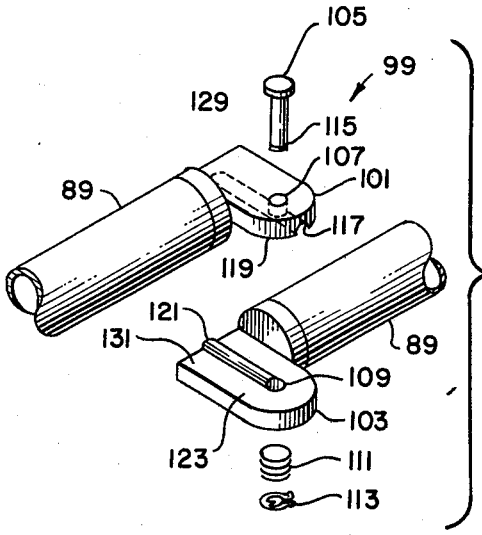
FIG. 8.
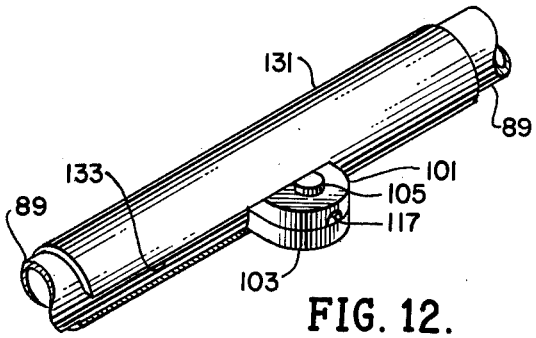
FIG. 12.
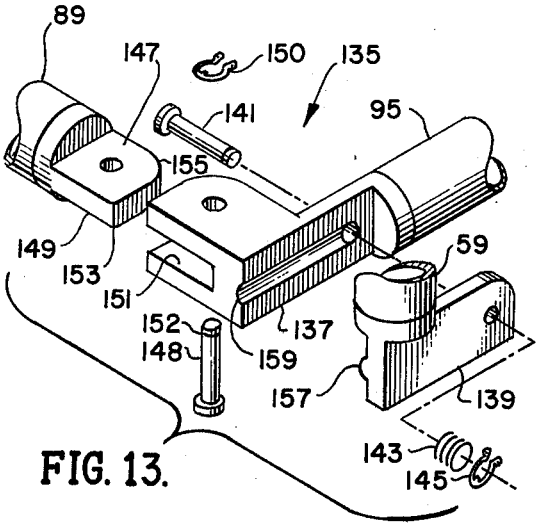
FIG. 13.
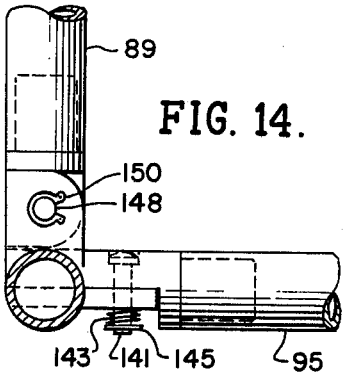
FIG. 14.
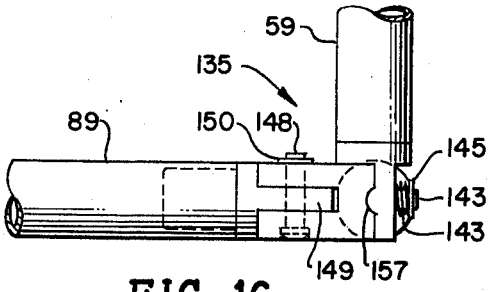
FIG. 16.
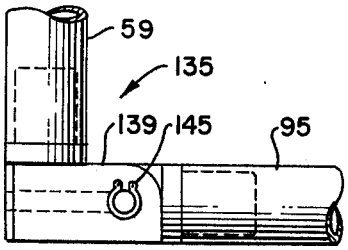
FIG. 15.

QUICKLY ERECTED BACK PACK TENT

BACKGROUND OF THE INVENTION

The present invention relates to portable tent structures and, more particularly, to a lightweight two-person shelter which in its collapsed configuration can be easily lashed to a hiker's back pack thus facilitating easy transportation of all components of the unit by a single person.

Hikers, campers, hunters, and others who must brave the outdoor elements for reason of recreation or necessity usually carry a sleeping bag which provide only minimal protection. If additional protective shelter is required, a tent pack must be carried which is bulky, cumbersome and impractical to attach to the hiker's back pack containing the essential amenities for outdoor living in an adverse environment.

The prior art tents, even though collapsible, have been bulky and cumbersome to carry over difficult terrain such as encountered by outdoorsmen in the environmental areas traveled.

More recent patents in the portable tent arts are cited as follows: Cater, U.S. Pat. No. 3,822,813 for a Back Pack Frame for Supporting a Tent; and Machenzie, U.S. Pat. No. 3,619,827 for a Lightweight Detachable Tent-Cot Means.

The Carter patent describes an L-shaped frame with extendable leg members which form a support frame from which the tent is hung. L-shaped members having sawtooth projections on the shorter legs are strapped to a tree trunk at the proper height to enable a tent member to be suspended therefrom. Separate dowel pins are required to lock the telescoping leg members in their extended position. The erection of this tent unit requires several preliminary operations; such as, finding a suitable level site in the proximity of a tree with a large trunk; dismantling the framework; removing dowel pins, etc. Such additional activities after a fatiguing hike through rough terrain are undesirable.

Other collapsible tent structures such as disclosed in the Mackenzie patent are still bulky in their collapsed state and require a greater erection-for-use time.

SUMMARY OF THE INVENTION

The present invention alleviates many of the disadvantages associated with the prior art and specifically to those factors of erection, its complexity and time requirement, and its compacted size for handling and carrying.

The above cited disadvantages are doubly aggravating when the hiker is physically exhausted at the end of the day when the time has come to make preparations for setting up camp in a suitable location and daylight is fading quickly.

The preferred embodiment of the invention described herein comprises a lightweight rectangular tent support frame which can be quickly opened to its functional state without removing or changing any of its component parts. The nylon tent unit unfolds to its functional shape when the tent support frame is locked into its upright position. The tent unit is fabricated from waterproof, flame-resistant nylon having a zippered side opening which can be attached to the leading upper edge of an adjoining second tent unit to form a covered breezeway.

To fold the tent structure in preparation of breaking the camp site, the four tubular upright members are kinked inwardly to allow the structure to collapse downwardly into a flat configuration after which the end members of the upper and lower rectangular frames are unlocked and folded inwardly thus forming a tube-like bundle. The elongated is then folded into an U-inverted configuration which nests around the back pack. This dismantling and packing operation can be performed within seconds.

BRIEF DESCRIPTION OF THE DRAWINGS

These and other advantages of the present invention are best understood through a reference to the drawings, in which:

FIG. 1 is a perspective view of the tent-pack comprising the present invention in its compacted and folded state and shown tied to a conventional hiker's back pack;

FIG. 2 is a perspective view of the present invention in its erected state ready for occupancy;

FIG. 3 is a perspective view of two tent units joined together by means of the side wall panels;

FIG. 4 is a perspective view of a typical corner locking stake;

FIG. 5 is a sectional view of the tubular framework fully extended in its open position taken along lines 5—5 on FIG. 2 with the nylon tent removed;

FIG. 6 is a view of the same tubular framework shown in FIG. 5 in the first stage of the folding operation;

FIG. 7 is a view of the same tubular framework shown in FIGS. 5 and 6 in the second stage of the folding operation;

FIG. 8 is a perspective view of the typical hinged fitting of the tubular framework showing all of the parts in an exploded position;

FIG. 9 is a top elevation view, partially broken away, showing the hinged fitting open in its assembled state;

FIG. 10 is a top elevation view of the hinged fitting in its closed position;

FIG. 11 is a right end elevation view of the closed hinged fitting shown in FIG. 10;

FIG. 12 is a perspective view of the typical hinged fitting in its open position with the slidable locking sleeve in place;

FIG. 13 is a perspective view of the corner hinged fitting of the tubular framework showing all of the parts in an exploded position;

FIG. 14 is a top elevation view of the corner hinged fitting in its opened position;

FIG. 15 is a front elevation view of the corner hinged fitting shown in FIG. 14; and FIG. 16 is a left side elevation view of the corner hinged fitting shown in FIGS. 14 and 15.

DETAILED DESCRIPTION OF THE PREFERRED EMBODIMENTS

Referring initially to FIG. 1, a back pack tent 11 is shown in its folded and collapsed state nested and tied around a conventional hiker's back pack 13. The U-shaped package formed by the collapsed tent 11 fits compactly around the top and sides of the hiker's back pack 13 thus facilitating its easy transportation over difficult terrain such as encountered by hikers and outdoorsmen.

FIG. 2 shows the tent 11 in its completely erected state and ready for occupancy. The tent unit 11 comprises a rectangular box-like tent unit 15 fabricated from flame-retardant, water-impervious, nylon material and a supporting lightweight tubular framework 17, made from aluminum or high tensile plastic tubing. The box-like tent unit 15 comprises a sloping water-shed roof panel 19, a front panel 21 having a flap entry 23 and a screened windown 25 with a storm flap 27, a large flap side panel 29 with a double pull zipper closure device 31, a side panel 33 with screened window 35 having a zippered closure flap 37, an end panel 39, and a floor panel 41. All wall and floor panels 19, 21, 29, 33, 39 and 41 are sewn together at seams 43 in a double folded method to be as impervious to water leakage as practical.

The box-like tent unit 15 is attached to the tubular framework 17 by a plurality of nylon reinforcement straps 45 which are sewn transversely across panels 19, 29 and 33. At the top leading edge 47 of the flap side panel 29, a plurality of strap loops 51 are sewn to the panel straps 45. A quick-acting closure means 53 comprised of a swivel or snap catch typical in the fabrication of tents and tarpaulins, is provided on each of the strap loops 51. Thus, the tent unit 15 can be quickly and easily removed from the tubular framework 17 when necessary for repair or replacement. The strap loops 51*a* at the top leading edge 55 of the side panel 33 are more elongated than the loops 51 at leading edge 47 of the flap panel 29, in order to hang the edge 55 lower than leading edge 47 and thus permit rain and moisture drain-off from the roof panel 19. A plurality of auxiliary loop straps 57 encircling the vertical tubular support members 59 of the framework 17 prevent the tent unit 15 from shifting laterally on the framework 17.

The flap side panel 29 can be detached at the sides and bottom by means of the double pull zippers 31 thus permitting the bottom edge 61 of the panel 29 to be attached to the top leading edge 47 of an adjoining back pack tent 11 in a duplex occupancy setup as shown in FIG. 3. Flap covered grommets 63 in the bottom edge 61 enable this edge to be snapped to the closure means 53 of the adjoining tent.

Referring now specifically to FIG. 4, a lightweight, aluminum, corner-locking stake 65 is shown. The stake 65 comprises a U-shaped upright member 67, riveted at 69 to the L-shaped stake member 71. The stake 65 as shown in FIG. 4 would be used for the right forward corner 73 of the framework 17, and the left rear corner 75. In order to embrace the upright 59 located at the left forward corner 77 and the right rear corner 79, the U-shaped upright 67 of the stake 65 is riveted facing left or in the opposite manner as shown in FIG. 4. The function of the corner-locking stake 67 is to anchor the tubular framework 17 to the ground at each corner and to lock the vertical support member 59 in its upright position.

Referring now specifically to FIGS. 5, 6 and 7, the base rectangular frame of the tubular framework 17 as taken along lines 5—5 on FIG. 2 is shown. For clarity of illustration, the tent unit 11 has been removed. The base frame 83, shown in FIG. 5, comprises nine short, straight, tubular struts and one telescoping strut 85. The two shorter sides 87 of the rectangular base frame 83 pivot inwardly at the midpoint as shown in dotted lines (FIG. 5) and are constructed of four tubular struts 89 of equal length. The end of each tubular strut 87 is equipped with a self-locking hinged fitting, the details of which will be explained later.

The two longer sides 91 of the rectangular base frame 83 are composed of three hinged tubular struts. Extreme end sections 93 are of equal length, as well as the end sections 95 of the lower side 91. End sections 95 are shorter in length than end sections 93 to enable the frame 83 to be folded into the inverted "U-shape" 97 without interference between its integral parts, as best shown in FIG. 7.

The central tubular strut 85 of the lower side member 91 is made to telescope within itself to compensate for the shortened width "W" of the inverted "U-shape" 97.

FIG. 6 shows the rectangular base frame 83 collapsed to the first stage of the folding operation. The tubular struts 89 are pivoted inwardly thereby fitting the pairs of tubular struts 93, 95 and 89 in the closest proximity to each other. Finally, both ends of the frame 83 are pivoted downward, as best shown in FIG. 7, to form the compacted inverted "U-shape" 97.

Although not shown in FIGS. 5, 6 and 7, the top rectangular frame 81, as shown in FIG. 2, may be identical in structure to the base rectangular frame 83, and folds into the "U-shape" 97 as described for frame 83. Referring again to FIG. 2, the four vertical tubular struts 59 of the framework 17 fold inwardly toward each other in the planes of side panels 29 and 33 to enable the top rectangular frame 81 to lower into the base rectangular frame 83. The above-described operation would be the initial step in the dismantling operation of the erected tent 11 as shown in FIG. 2.

FIGS. 8 through 15 illustrated details of the various pivotal connector members in the total tubular framework 17. In FIG. 8, the composite components of the typical longitudinal hinged fitting 99 are shown in an exploded or dissassembled position. Two pivoting components 101 and 103 advantageously made of aluminum or molded plastic are held together by means of a shouldered dowel pin 105 passing through holes 107 and 109. A compression spring 111 is held in place by means of snap ring 113 which engages the end of pin 105 in an undercut groove 115. Pivoting member 101 has a semicircular recess 117 formed along the lateral axis of the underside 119. Pivoting member 103 has a half-round detent 121 projecting from its top surface 123. When two tubular struts 89, connected together by hinged fitting 99, are unfolded and extended along a longitudinal axis, the detent 121 snaps into the recess 117 and the mating halves 101 and 103 of the fitting 99 are held in a locked "unfolded" position by means of the compression spring 111. By appling pressure in the direction of arrow 125, as shown in FIG. 9, the hinged fitting 99 is "unlocked" when the pressure overcomes the compression force of spring 111 and permits the hinged fitting 99 to pivot to its "folded" position as shown in FIG. 10. The partial engagement of detent 121 with recess 117 keeps the two tubular struts 89 in the "folded" position, whereas the full detent 121 is engaged in the "unfolded" position. The reduced diameter 127 of both pivoting components 101 and 103 are serrated to prevent twisting when press fitting into the tubular struts 89. Molded plastic components are cemented in place. It should be noted here that the squared corners 129 and 131 on pivotal components 101 and 103 respectively prevent the pivoting of tubular struts 89 in the opposite direction to arrow 125.

Referring now to FIG. 12, a slidable locking sleeve 131 is shown. When used to "lock" the hinged fitting 99 in a more positive manner than the detent engagement, the sleeve 131 is slid over the hinged fitting 99. A longitudinal slot 133 permits the sleeve 131 to clear the projecting members of hinge components 101 and 103 and stop its travel at midpoint when the end of the slot 133 abuts the projecting ears of hinge components 101 and 103. A plurality of slidable locking sleeves 131 are assembled onto the framework 17 during its fabrication, as clearly illustrated in FIG. 2.

Referring now specifically to FIGS. 13 through 16, a triple-strut corner pivotal fitting 135 is shown in detail. A main L-shaped hinge component 137 is pressed into the ends of tubular struts 93 and 95 of upper and lower rectangular frames 81 and 83. The upright tubular struts 59 are pressed on a serrated diameter of a second hinge member 139. The upright strut 59 and the horizontal tubular strut 95 with their hinged fittings 137 and 139 are held together by means of dowel pin 141, compression spring 143, and snap ring 145, in like manner as hinged fitting 99.

The hinge componeent 139 has a raised half-round detent 157 which snaps into engagement with the semicircular recess 159 in hinge component 137 against the compression force of spring 143 to keep the tubular struts 59 in a locked position.

The third tubular strut 89 is fitted with pivotal component 147 having an ear 149 which slips into slot 151 of component 137. Ear 149 has a squared corner 153 and curved edge 155 which permits the tubular section 89 to pivot inwardly in one direction only. The pivoted components 147 and 137 are held together by dowel pin 148 and snap ring 150 locked in position in undercut groove 152.

The hinge component 147 is without the detent means, but is held rigidly in its "unfolded" position by means of the corner locking stake 65 (FIG. 4), two of which are shown at corners 73 and 79 in FIG. 2.

In summary, there has been described a back pack tent 11 having a structural framework 17 fabricated of lightweight aluminum or plastic tubing which can be erected to its ready-for-occupancy configuration, as shown in FIG. 2, within a matter of minutes from its compacted, easy-to-carry, U-shaped pack. All commponents of the tent shelter are integral within the pack, requiring no wrenches or tools for its erection or assembly. Dismantling and folding is as easily accomplished as the setup-for-occupancy operation. The easy portability and quick-erection qualities of this invention greatly enhance its utility for hiking trips when the time element must be minimized in making preparations for "pitching" camp with daylight quickly fading.

What is claimed is:

1. A collapsible tent structure, comprising:

a primary unitary collapsible support framework formed of a plurality of lightweight, high tensile tubular strut members connected by a plurality of hinged fittings permitting pivotal movement of the component strut members to allow said framework to be folded into a compact inverted U-shape for carrying or unfolded into a substantially three dimensional rectangular frame structure for utilization as a tent support structure, said framework in its unfolded position comprising two rectangular frames pivotally connected together at each corner by four corner upright struts, both of said corner upright struts being foldable so that said framework can be collapsed into a generally flat elongated bundle which is then folded into said compact inverted U-shape without disconnecting any of said strut members, each edge of said rectangular frame being formed by at least two of said pivotally connected struts and the longest edge thereof being formed by no less than three of said pivotally connected struts with the maximum strut length (and, therefore, maximum length of any side of the folded U-shape configuration) being substantially less than the shortest edge of the unfolded rectangular frame;

a foldable fabric tent of a rectangular box-like configuration having a roof, side, and floor panels;

means for attaching said foldable fabric tent to said primary collapsible support framework, said tent remaining attached to said framework in both its folded and unfolded positions; and means for locking said plurality of hinged fittings within the primary support framework in an unfolded, extended position.

2. A collapsible support framework as set forth in claim 1 wherein:

said component strut members fold upon and adjacent to each other to form said compact inverted U-shape so that the total tent structure may be nestled around a conventional hiker's pack.

3. A collapsible support framework as set forth in claim 1 wherein:

said means for locking said plurality of hinged fittings are self-locking in the unfolded extended position.

4. A collapsible support framework as set forth in claim 3 wherein:

said means for locking said hinged fittings in the unfolded extended position comprises a spring loaded connector pin and mating detent means on the hinge components.

5. A collapsible support framework as set forth in claim 3 wherein:

said means for locking said hinged fittings in the unfolded extended position comprises a slidable slotted sleeve.

6. A collapsible support framework as set forth in claim 1 wherein:

the corner upright strut members fold inwardly in the vertical planes of the side panels;

said two rectangular frames having end strut members which fold inwardly in the horizontal planes of the roof and floor panels so as to form said generally flat elongated bundle; and the outer extremities of said generally flat elongated bundle is then folded downwardly to form said inverted U-configuration.

7. A collapsible support framework as set forth in claim 1 wherein said two rectangular frames include central strut members which telescope to enable said rectangular frames to be folded into said inverted U-configuration without interference between its integral parts.

* * * * *

UNITED STATES PATENT AND TRADEMARK OFFICE

CERTIFICATE OF CORRECTION

PATENT NO. : 4,077,418

DATED : March 7, 1978

INVENTOR(S) : Wilfred Cohen

It is certified that error appears in the above-identified patent and that said Letters Patent are hereby corrected as shown below:

Column 1, line 24, "Cater" should be --Carter--;
Column 1, line 25, "Machenzie" should be --Mackenzie--;
Column 3, line 5, "windown" should be --window--;
Column 4, line 27, "illustrated" should be --illustrate--;
Column 4, line 46, "appling" should be --applying--;
Column 4, line 56, "fitting" should be --fitted--;
Column 5, line 16, "componeent" should be --component--;
Column 5, line 20, after "locked" insert --upright--;
Column 5, line 60, after "both of said" insert --rectangular frames and said--;
Column 6, line 9, "side" should be --edge--;
Column 6, line 27, after "hikers" insert --back--.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*